US008016411B2

(12) United States Patent
Sakagami

(10) Patent No.: US 8,016,411 B2
(45) Date of Patent: Sep. 13, 2011

(54) PRINTING APPARATUS

(75) Inventor: Yusuke Sakagami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 824 days.

(21) Appl. No.: 12/101,684

(22) Filed: Apr. 11, 2008

(65) Prior Publication Data

US 2008/0253797 A1 Oct. 16, 2008

(30) Foreign Application Priority Data

Apr. 12, 2007 (JP) ..... 2007-104523
Jan. 18, 2008 (JP) ..... 2008-008806

(51) Int. Cl.
*B41J 2/01* (2006.01)
*G03G 21/20* (2006.01)

(52) U.S. Cl. ..... 347/104; 399/92

(58) Field of Classification Search ..... 347/104, 347/105; 399/92, 93
See application file for complete search history.

(56) References Cited

U.S. PATENT DOCUMENTS

| | | | | |
|---|---|---|---|---|
| 4,080,053 | A * | 3/1978 | Friday | 399/317 |
| 6,092,891 | A * | 7/2000 | Okubo et al. | 347/104 |
| 7,396,122 | B2 * | 7/2008 | Masumi et al. | 347/102 |
| 2002/0027587 | A1 * | 3/2002 | Sugaya et al. | 347/104 |

FOREIGN PATENT DOCUMENTS

JP 2005-075475 3/2005

* cited by examiner

*Primary Examiner* — Daniel Petkovsek
(74) *Attorney, Agent, or Firm* — Workman Nydegger

(57) ABSTRACT

A printing apparatus includes a first transport belt group including endless belts arranged at predetermined intervals in a direction intersecting a transport direction of a printing medium, a second transport belt group including endless belts arranged so as to oppose the first transport belt group and configured to transport the printing medium while the printing medium is clamped between the first transport belt group and the second transport belt group, and a group of liquid ejecting heads provided between the endless belts of the first transport belt group or between the endless belts of the second transport belt group and configured to eject liquid onto the printing medium being transported.

5 Claims, 6 Drawing Sheets

PRINTING APPARATUS

BACKGROUND

1. Technical Field

The present invention relates to a printing apparatus that performs printing by ejecting liquid from a liquid ejecting head onto a printing medium transported by a transport belt.

2. Related Art

In a printing apparatus disclosed as an example of such a printing apparatus in JP-A-2005-75475, a printing medium is electrostatically attracted to an electrostatically charged transport belt so as to retain the position of the printing medium relative to the transport belt.

However, since the transport belt is electrostatically charged in the above-described printing apparatus as the related art, for example, if fine satellite droplets are produced as well as main ink droplets during ejection (discharging) of liquid, such as ink droplets, onto the printing medium and ink mist is generated by floating of the satellite droplets, the ink mist is attracted and attached to the transport belt. This may soil the printing medium transported by the transport belt.

SUMMARY

An advantage of some aspects of the invention is that ink mist is prevented from adhering to a transport belt in a printing apparatus.

A printing apparatus according to an aspect of the invention includes a first transport belt group including endless belts arranged at predetermined intervals in a direction intersecting a transport direction of a printing medium; a second transport belt group including endless belts arranged so as to oppose the first transport belt group and configured to transport the printing medium while the printing medium is clamped between the first transport belt group and the second transport belt group; and a group of liquid ejecting heads provided between the endless belts of the first transport belt group or between the endless belts of the second transport belt group and configured to eject liquid onto the printing medium being transported.

In this case, the position of the printing medium relative to the transport belt can be retained during transportation, without using static electricity. For this reason, it is possible to prevent ink mist from being electrostatically attracted and attached to the transport belt. This is different from, for example, a method in which the position of the printing medium relative to the transport belt is retained by electrostatically attracting the printing medium to the electrostatically charged transport belt.

The printing apparatus may further include a collecting unit configured to form an air flow passing through a space surrounded by inner peripheral surfaces of the endless belts of the first transport belt group or the second transport belt group and to collect mist of the liquid contained in the air flow.

In this case, the amount of ink mist floating in the space between the head unit and the transport belt can be reduced. Further, the ink mist is prevented from directly or indirectly adhering to the printing medium and from soiling the printing medium.

The printing apparatus may further include a mist guide provided along the inner peripheral surfaces of the endless belts of the first transport belt group or the second transport belt group.

In this case, ink mist floating between the printing medium and the ink jet head can be prevented from flowing downstream in the transport direction because of the air flow formed by transportation of the printing medium and from adhering to the components. This can more properly prevent the printing medium from being soiled with ink mist.

The collecting unit may include a duct configured to take in the air flow and to discharge the air flow from an air outlet, a liquid absorber provided at a position in the duct with which the air flow collides and configured to absorb the mist contained in the colliding air flow, and a filter provided at the air outlet and configured to absorb the mist contained in the air flow discharged from the air outlet.

In this case, since the ink mist is also absorbed by the liquid absorber, the frequency of exchange of the filter can be reduced, and the ink mist can be collected efficiently.

A surface of each of the endless belts of the first transport belt group or the second transport belt group may be covered with a repellent coating.

In this case, ink ejected on the printing medium is prevented from adhering to the transport belt, and the printing medium is prevented from being soiled with the ink on the transport belt.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink jet printer serving as an example of a printing apparatus according to an embodiment of the invention will be described below with reference to the drawings. The ink jet printer prints characters, images, and so on a printing medium by ejecting ink.

Configuration

Figure 1:
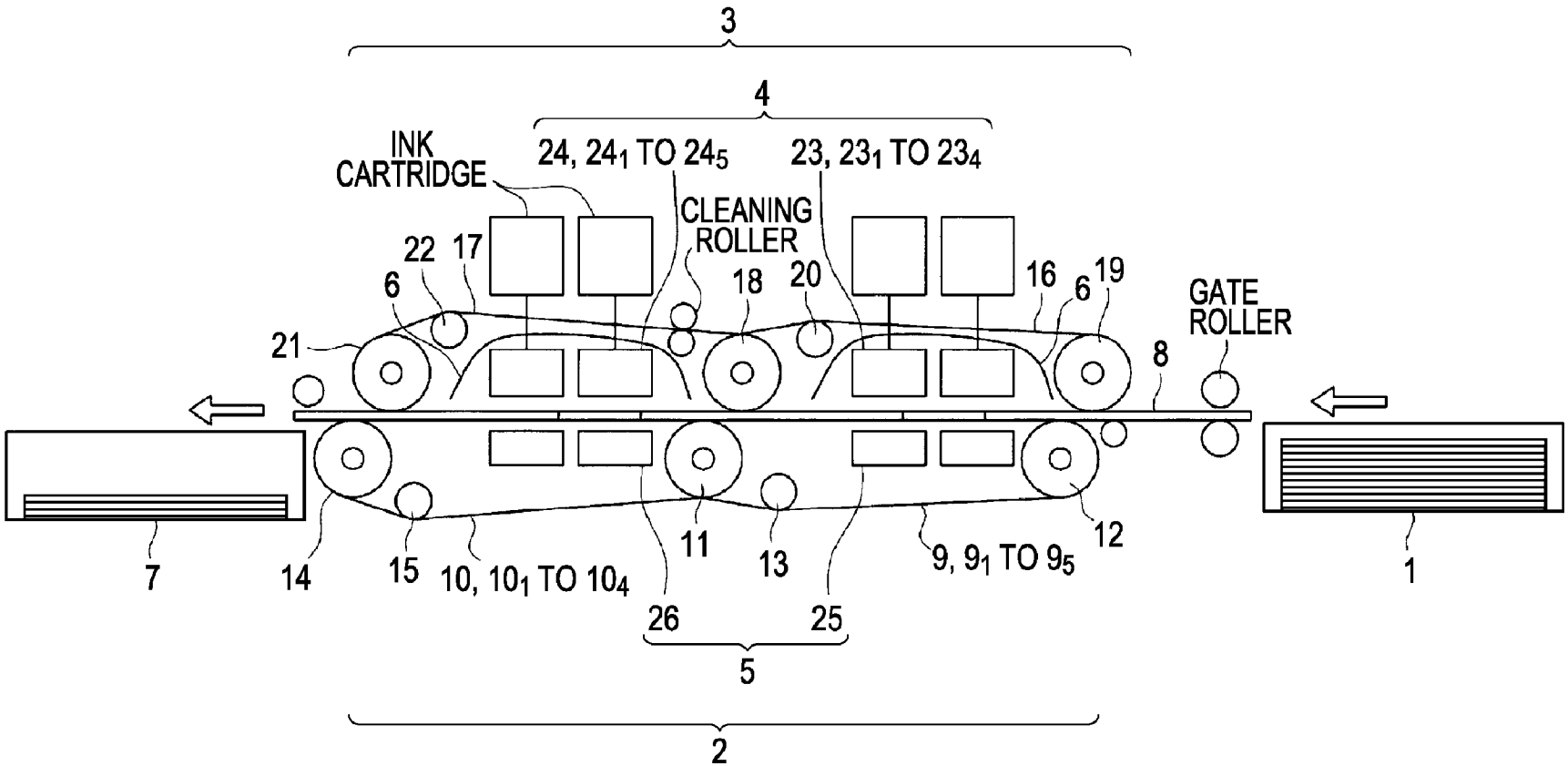
FIG. 1 is a schematic view showing the configuration of an ink jet printer according to an embodiment of the invention.
Figure 2:
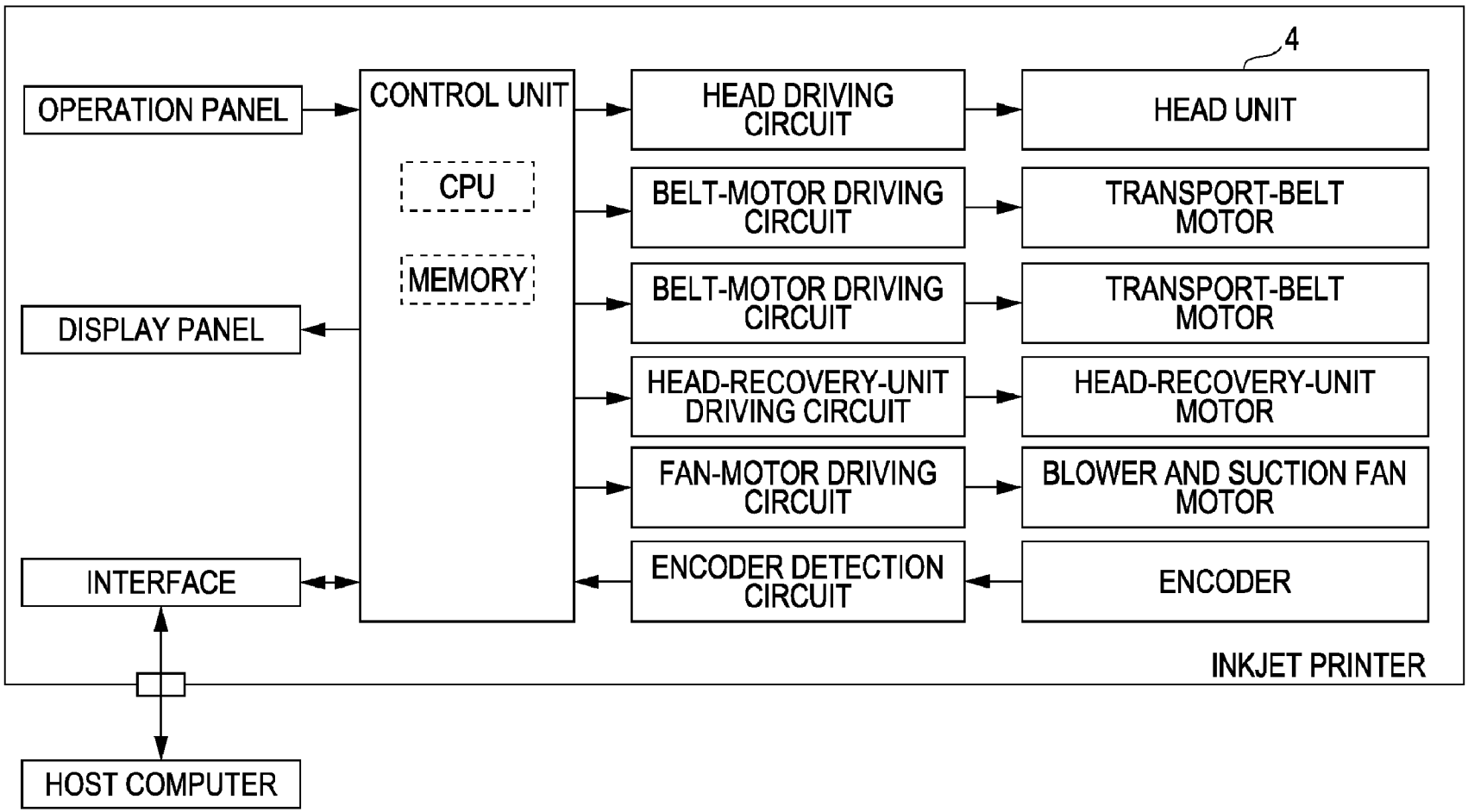
FIG. 2 is a block diagram showing the internal configuration of the ink jet printer.

FIG. 1 is a schematic view showing the configuration of the ink jet printer according to the embodiment. FIG. 2 is a block diagram showing the internal configuration of the ink jet printer.

As shown in FIG. 1, the ink jet printer includes a sheet supply unit 1, a lower transport belt unit 2, an upper transport belt unit 3, a head unit 4, a head recovery unit 5, a mist collecting unit 6, and a sheet output unit 7.

The sheet supply unit 1 stores a plurality of printing media 8, and is provided on the upstream side in a transport direction of the recording media 8. The stored printing media 8 are fed one by one onto an upper side of the lower transport belt unit 2 by a pickup roller and so on.

Figure 3:
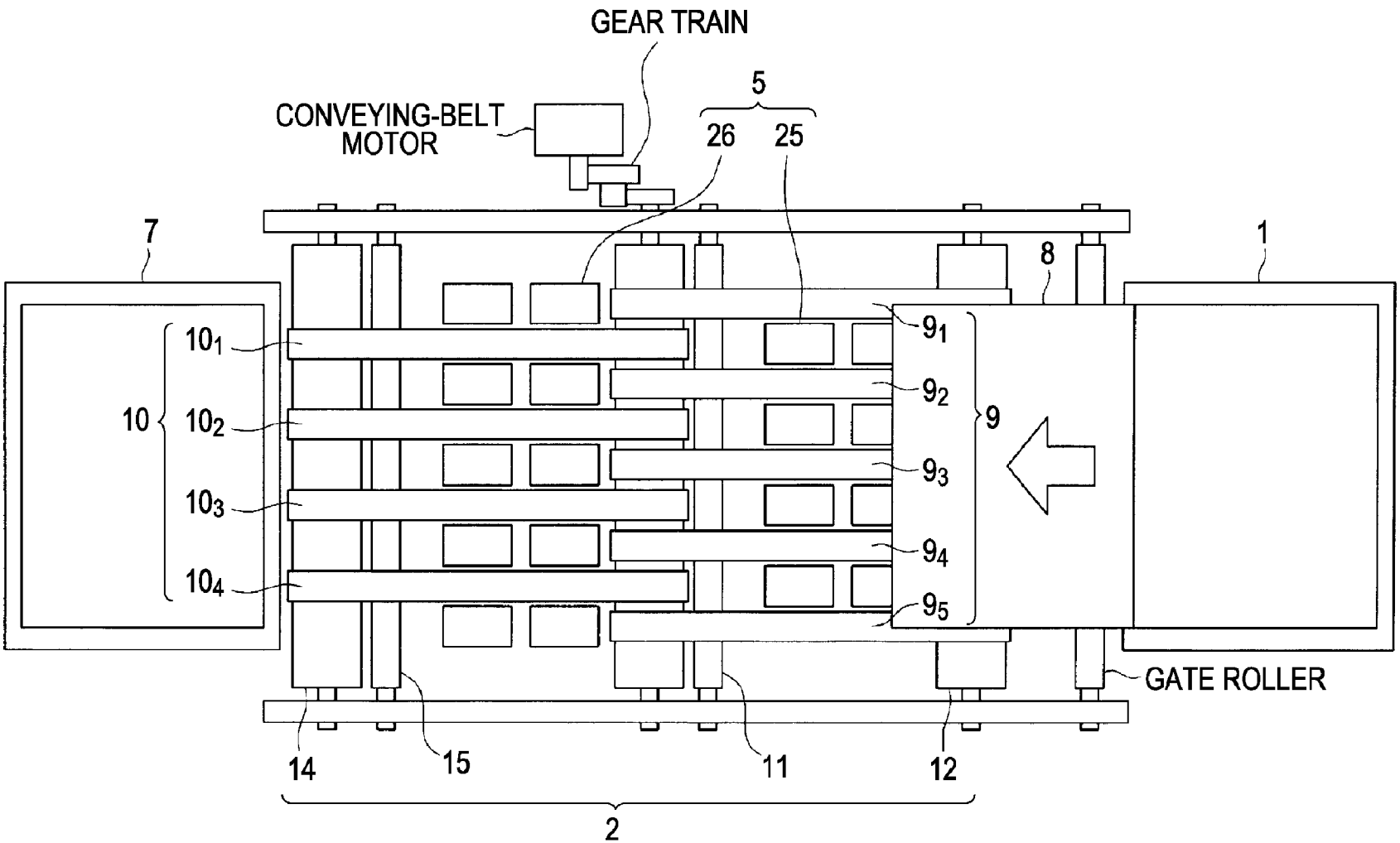
FIG. 3 is a top plan view of the ink jet printer from which an upper transport belt unit and a head unit are removed.

FIG. 3 is a top plan view of the ink jet printer from which the upper transport belt unit 3 and the head unit 4 are removed.

As shown in FIG. 3, the lower transport belt unit 2 includes an upstream lower transport unit 9, and a downstream lower transport unit 10 disposed downstream of the upstream lower transport unit 9.

The upstream lower transport unit 9 includes a plurality of transport belts $\mathbf{9}_1$ to $\mathbf{9}_5$. The transport belts $\mathbf{9}_1$ to $\mathbf{9}_5$ extend in the transport direction of the printing media 8, and are arranged at predetermined intervals in a direction intersecting the transport direction. The transport belts $\mathbf{9}_1$ to $\mathbf{9}_5$ are wound around an upstream lower driven roller 12 that rotates in the transport direction of the printing media 8, a lower driving roller 11 disposed on the downstream side in the transport direction so as to rotate in the transport direction, and an upstream lower tension roller 13. When the lower driving roller 11 is rotated by a transport-belt motor, the transport belts $\mathbf{9}_1$ to $\mathbf{9}_5$ are rotated in the transport direction.

In the upstream lower transport unit 9, a printing medium 8 supplied from the sheet supply unit 1 is placed on upper surfaces of the transport belts $\mathbf{9}_1$ to $\mathbf{9}_5$, and is transported from the upstream side of the head unit 4 to the downstream lower transport unit 10, that is, in the direction of the arrow in FIG. 1.

The downstream lower transport unit 10 includes a plurality of transport belts $\mathbf{10}_1$ to $\mathbf{10}_4$. The transport belts $\mathbf{10}_1$ to $\mathbf{10}_4$ are arranged at predetermined intervals in the direction intersecting the transport direction of the printing medium 8 so as to be placed in a staggered relationship with the transport belts $\mathbf{9}_1$ to $\mathbf{9}_5$ in plan view. The transport belts $\mathbf{10}_1$ to $\mathbf{10}_4$ are wound around the lower driving roller 11, around which the transport belts $\mathbf{9}_1$ to $\mathbf{9}_5$ of the upstream lower transport unit 9 are wound, a downstream lower driven roller 14 disposed on the downstream side in the transport direction so as to rotate in the transport direction, and a downstream lower tension roller 15. When the lower driving roller 11 is rotated by the transport-belt motor, the transport belts $\mathbf{10}_1$ to $\mathbf{10}_4$ are rotated in the transport direction.

In the downstream lower transport unit 10, the printing medium 8 transported by the upstream lower transport unit 9 is transferred onto upper surfaces of the transport belts $\mathbf{10}_1$ to $\mathbf{10}_4$, and the transferred printing medium 8 is transported from the downstream side of the head unit 4 to the sheet output unit 7.

Figure 4:
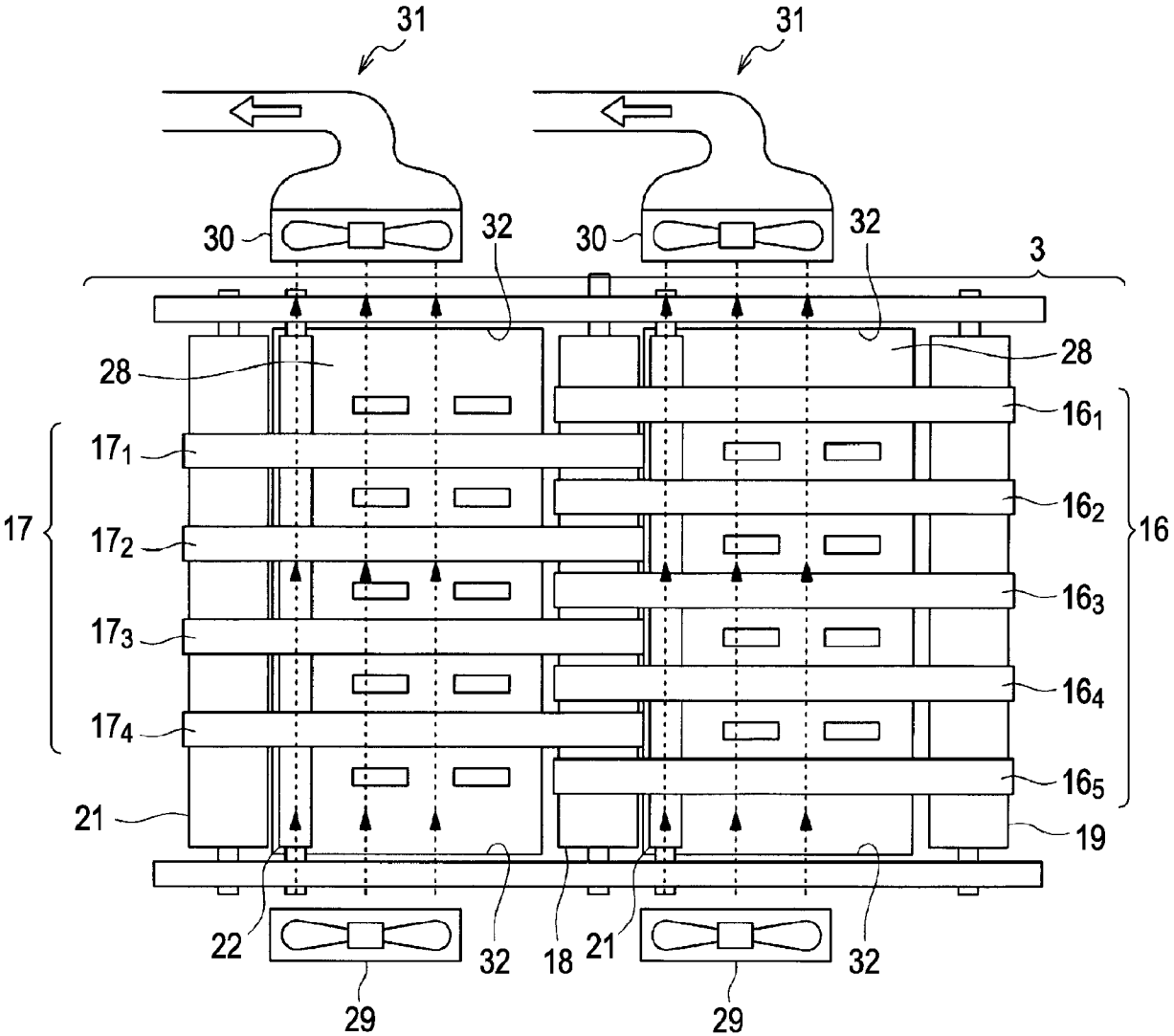
FIG. 4 is a top plan view of the ink jet printer from which the head unit is removed.

FIG. 4 is a top plan view of the ink jet printer according to the embodiment from which the head unit 4 is removed.

As shown in FIG. 4, the upper transport belt unit 3 includes an upstream upper transport unit 16 disposed above the upstream lower transport unit 9, and a downstream upper transport unit 17 disposed above the downstream lower transport unit 10.

The upstream upper transport unit 16 includes a plurality of transport belts $\mathbf{16}_1$ to $\mathbf{16}_5$. The transport belts $\mathbf{16}_1$ to $\mathbf{16}_5$ are arranged at predetermined intervals in the direction intersecting the transport direction of the printing medium 8 so that lower surfaces thereof face the upper surfaces of the transport belts $\mathbf{9}_1$ to $\mathbf{9}_5$ of the upstream lower transport unit 9 and contact the printing medium 8 transported by the upstream lower transport unit 9. The transport belts $\mathbf{16}_1$ to $\mathbf{16}_5$ are wound around an upstream upper driven roller 19 that rotates in the transport direction of the printing medium 8, and an upper driving roller 18 and an upstream upper tension roller 20 disposed on the downstream side in the transport direction so as to rotate in the transport direction. When the upper driving roller 18 is rotated by a transport-belt motor, the transport belts $\mathbf{16}_1$ to $\mathbf{16}_5$ are rotated in the transport direction.

The upstream upper transport unit 16 presses the printing medium 8, which is transported by the upstream lower transport unit 9, against the upstream lower transport unit 9, and generates frictional forces between the transport belts $\mathbf{9}_1$ to $\mathbf{9}_5$ of the upstream lower transport unit 9 and the printing medium 8 and between the transport belts $\mathbf{16}_1$ to $\mathbf{16}_5$ of the upstream upper transport unit 16. The printing medium 8 is thereby clamped between the upstream lower transport unit 9 and the upstream upper transport unit 16.

The downstream upper transport unit 17 includes a plurality of transport belts $\mathbf{17}_1$ to $\mathbf{17}_4$. The transport belts $\mathbf{17}_1$ to $\mathbf{17}_4$ are arranged at predetermined intervals in the direction intersecting the transport direction of the printing medium 8 so that outer peripheral surfaces thereof face the upper surfaces of the transport belts $\mathbf{10}_1$ to $\mathbf{10}_4$ of the downstream lower transport unit 10 and contact the printing medium 8 transported by the downstream lower transport unit 10. The transport belts $\mathbf{17}_1$ to $\mathbf{17}_4$ are wound around the upper driving roller 18, around which the transport belts $\mathbf{16}_1$ to $\mathbf{16}_5$ of the upstream upper transport unit 16 are wound, and a downstream upper driven roller 21 and a downstream upper tension roller 22 disposed on the downstream side in the transport direction so as to rotate in the transport direction. When the upper driving roller 18 is rotated by the transport-belt motor, the transport belts $\mathbf{17}_1$ to $\mathbf{17}_4$ are rotated in the transport direction.

The downstream upper transport unit 17 presses the printing medium 8, which is transported by the downstream lower transport unit 10, against the downstream lower transport unit 10, and generates frictional forces between the transport belts $\mathbf{10}_1$ to $\mathbf{10}_4$ of the downstream lower transport unit 10 and the printing medium 8 and between the transport belts $\mathbf{17}_1$ to $\mathbf{17}_4$ of the downstream upper transport unit 17 and the printing medium 8. The printing medium 8 is thereby clamped between the downstream lower transport unit 10 and the downstream upper transport unit 17.

The surface of each of the transport belts $\mathbf{17}_1$ to $\mathbf{17}_4$ in the downstream upper transport unit 17 is covered with a water-repellent coating so that ink does not adhere to the surface even when the transport belts $\mathbf{17}_1$ to $\mathbf{17}_4$ touch a printed printing medium 8. For example, the water-repellent coating is formed of PTFE (polytetrafluoroethylene), PFA (polytetrafluoroethylene-perfluoroalkyl vinyl ether copolymer), ETFE (ethylene-tetrafluoroethylene copolymer), FEP (tetrafluoroethylene-hexafluoropropylene copolymer), silicone rubber, or fluororubber.

In order for the printing medium 8 to be properly clamped between the upstream lower transport unit 9 and the upstream upper transport unit 16 and between the downstream lower transport unit 10 and the downstream upper transport unit 17, the upstream upper transport unit 16 and the downstream upper transport unit 17 may also include a biasing member, such as a pair of rollers or an elastic member, for increasing the pressing forces of the transport belts $\mathbf{16}_1$ to $\mathbf{16}_5$ of the upstream upper transport unit 16 and the transport belts $\mathbf{17}_1$ to $\mathbf{17}_4$ of the downstream upper transport unit 17.

The head unit 4 includes an upstream head unit 23 disposed above the upstream lower transport unit 9, and a downstream head unit 24 disposed downstream of the upstream head unit 23 and above the downstream lower transport unit 10.

The upstream head unit 23 includes a plurality of ink jet heads $\mathbf{23}_1$ to $\mathbf{23}_4$. The ink jet heads $\mathbf{23}_1$ to $\mathbf{23}_4$ are arranged at predetermined intervals in the direction intersecting the transport direction of the printing medium 8 so that lower surfaces thereof face the spaces between the transport belts $\mathbf{9}_1$ to $\mathbf{9}_5$ of the upstream lower transport unit 9. That is, the intervals of the ink jet heads $\mathbf{23}_1$ to $\mathbf{23}_4$ are equal to the distances between the adjacent transport belts $\mathbf{9}_1$ to $\mathbf{9}_5$ of the upstream lower transport unit 9. The transport belts $\mathbf{9}_1$ to $\mathbf{9}_5$ of the upstream lower transport unit 9 are provided in non-printing regions of the ink jet heads $\mathbf{23}_1$ to $\mathbf{23}_4$.

In each of the ink jet heads $23_1$ to $23_4$, a plurality of nozzle arrays corresponding to colors of black (K), yellow (Y), magenta (M), and cyan (C) extend in the direction intersecting the transport direction of the printing medium 8, and are arranged in order from the upstream side in the transport direction. In response to a print execution command, the upstream head unit 23 discharges ink droplets downward from the ink jet heads $23_1$ to $23_4$, that is, onto non-contact regions of the printing medium 8 that are not in contact with the transport belts $9_1$ to $9_5$, thus performing printing on the non-contact regions.

The downstream head unit 24 includes a plurality of ink jet heads $24_1$ to $24_5$. The ink jet heads $24_1$ to $24_5$ are arranged at predetermined intervals in the direction intersecting the transport direction of the printing medium 8 so that lower surfaces thereof face the spaces between the transport belts $10_1$ to $10_4$ of the downstream lower transport unit 10. That is, the intervals of the ink jet heads $24_1$ to $24_5$ are equal to the distances between the adjacent transport belts $10_1$ to $10_4$ of the downstream lower transport unit 10. The ink jet heads $24_1$ to $24_5$ are provided in non-printing regions of the ink jet heads $23_1$ to $23_4$ of the upstream head unit 23, and the transport belts $10_1$ to $10_4$ of the downstream lower transport unit 10 are provided in non-printing regions of the ink jet heads $24_1$ to $24_5$.

In each of the ink jet heads $24_1$ to $24_5$, a plurality of nozzle arrays corresponding to colors K, Y, M, and C extend in the direction intersecting the transport direction of the printing medium 8, and are arranged in order from the upstream side in the transport direction.

In response to a print execution command, the downstream head unit 24 discharges ink droplets onto regions of the printing medium 8 that are not in contact with the transport belts $10_1$ to $10_4$, that is, onto remaining regions that have not been printed by the upstream head unit 23, thus performing printing on the remaining regions.

In the upstream head unit 23 and the downstream head unit 24, when an execution command for marginless printing is issued as a print execution command, printing is performed in a larger size on the printing medium 8 in consideration of the transport accuracy of the printing medium 8 by the lower transport belt unit 2 as if printing was performed on a printing medium having sides slightly longer than those of the actual printing medium 8 (for example, longer by 2 mm). Some ink droplets are ejected outside the actual printing medium 8 during printing.

When ink droplets are ejected from the upstream head unit 23 and the downstream head unit 24 onto the printing medium 8, satellite droplets are produced as well as main ink droplets. Satellite droplets floating in the air may generate ink mist.

Particularly during marginless printing, the edges of the printing medium 8 are overhung, and some ink droplets are ejected past the printing medium 8 toward caps 27 (described below). Therefore, ink mist is more easily generated than during normal printing.

The head recovery unit 5 includes a plurality of upstream head recovery units 25, and a plurality of downstream head recovery units 26 disposed downstream of the upstream recovery head units 25.

Figure 5:
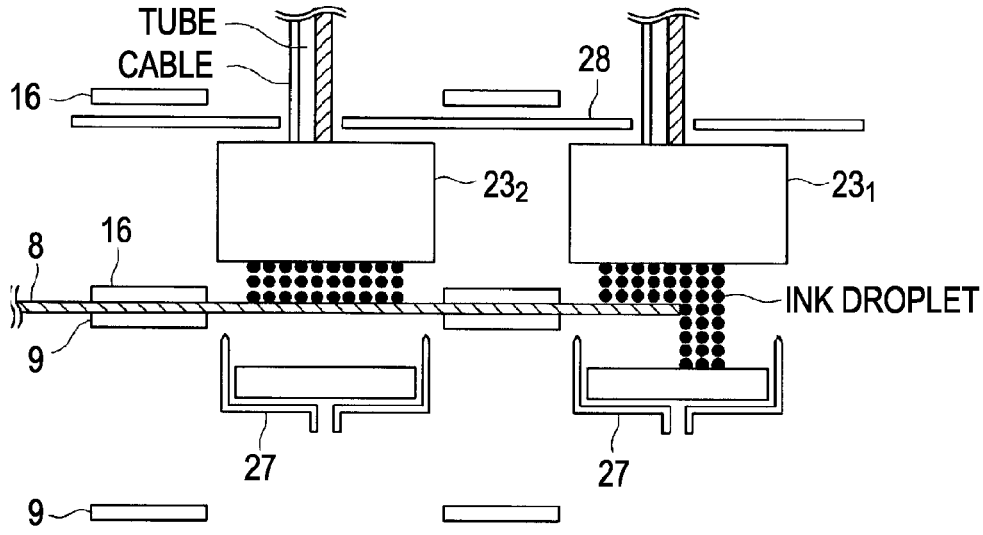
FIG. 5 is a cross-sectional view of a head recovery unit, taken in a direction intersecting a direction of transport of a printing medium by an upper transport belt unit.

FIG. 5 is a cross-sectional view of the head recovery unit 5, taken in the direction intersecting the transport direction of the printing medium 8.

As shown in FIG. 5, the upstream head recovery units 25 are provided between the transport belts $9_1$ to $9_5$ of the upstream lower transport unit 9 so that apertures of caps 27 oppose the nozzles of the ink jet heads $23_1$ to $23_4$ in the upstream head unit 23. When a printing medium 8 does not lie between the upstream head recovery units 25 and the ink jet heads $23_1$ to $23_4$ that oppose each other, the upstream head recovery units 25 conduct head recovery for the ink jet heads $23_1$ to $23_4$.

The downstream head recovery units 26 are provided between the transport belts $10_1$ to $10_4$ of the downstream lower transport unit 10 so that apertures of caps 27 oppose the nozzles of the ink jet heads $24_1$ to $24_5$ in the downstream head unit 24. When a printing medium 8 does not lie between the downstream head recovery units 26 and the ink jet heads $24_1$ to $24_5$ that oppose each other, the downstream head recovery units 26 conduct head recovery for the ink jet heads $24_1$ to $24_5$.

As shown in FIG. 4, the mist collecting unit 6 is provided for each of the upstream upper transport unit 16 and the downstream upper transport unit 17, and includes a mist guide 28, a blower fan 29, a suction fan 30, and a mist collecting section 31.

The mist guide 28 is provided on the inner peripheral sides of the transport belts $16_1$ to $16_5$ in the upstream upper transport unit 16, and also provided on the inner peripheral sides of the transport belts $17_1$ to $17_4$ in the downstream upper transport unit 17. The mist guides 28 cover the upstream head unit 23 and the downstream head unit 24 so that ink mist generated in the upstream head unit 23 and the downstream head unit 24 will not adhere to the components of the upstream transport belt unit 3, for example, the upstream upper transport unit 16, the downstream upper transport unit 17, the upper driving roller 18, the upstream upper driven roller 19, the upstream upper tension roller 20, the downstream upper driven roller 21, and the downstream upper tension roller 22, and so that the ink mist will not be diffused.

Each mist guide 28 has openings 32 at both ends in the direction intersecting the transport direction of the printing medium 8, that is, at both sides of the lower transport belt unit 2.

Each blower fan 29 is disposed at one of the openings 32 in the corresponding mist guide 28. In order to remove ink mist floating in the mist guide 28 by air flows, the blower fan 29 sends air from the opening 32 into the mist guide 28, that is, into the space between the upstream head unit 23 and the upstream lower transport unit 9 or the space between the downstream head unit 24 and the downstream lower transport unit 10.

The suction fan 30 is provided at the other opening 32 of the mist guide 28. The suction fan 30 draws in air flows which are generated by the blower fan 29 and pass through the mist guide 28, that is, air flows that take in ink mist while passing through the mist guide 28, and the suction fan 30 sends the air flows to the mist collecting section 31.

Figure 6:
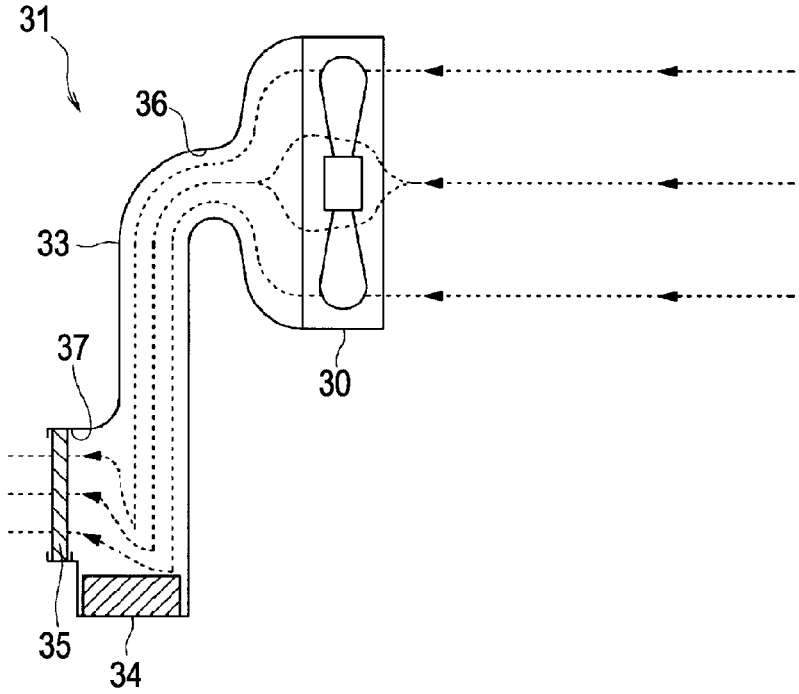
FIG. 6 is a cross-sectional view of a mist collecting unit, taken in the direction intersecting the direction of transport of the printing medium by the upper transport belt unit.

FIG. 6 is a cross-sectional view of the mist collecting section 31, taken in the direction intersecting the transport direction of the printing medium 8.

As shown in FIG. 6, the mist collecting section 31 includes a duct 33, an ink absorber 34, and a filter 35.

The duct 33 includes an air inlet 36 for taking in air flows from the suction fan 30, and an air outlet 37 for discharging the taken air flows. The air inlet 36 is provided in an upper portion of the duct 33, and the air outlet 37 is provided in a lower portion of the duct 33.

The ink absorber 34 is disposed in the lowermost portion of the duct 33. The air flows traveling from the air inlet 36 toward the air outlet 37 collide with the ink absorber 34, so that ink mist contained in the air flows is absorbed by the ink absorber 34.

When ink mist attached to the inner wall of the duct 33 drips in droplets to the lowermost portion of the duct 33, the ink absorber 34 also absorbs these ink droplets.

The filter 35 is provided at the air outlet 37 of the duct 33, and collects ink mist, which has not been absorbed by the ink absorber 34, from the air flows discharged from the air outlet 37.

The sheet output unit 7 is provided on the downstream side in the transport direction of the printing medium 8, and receives and stores the printing medium 8 printed by the head unit 4.

Operation

The operation of the ink jet printer according to the embodiment will now be described.

First, when a print execution command is issued from a host computer, one printing medium 8 is taken out of the sheet supply unit 1, and the orientation of the printing medium 8 is corrected by gate rollers. Then, the printing medium 8 is transported on the transport belts $\mathbf{9}_1$ to $\mathbf{9}_5$ of the lower transport belt unit 2. In a state in which the printing medium 8 is clamped between the transport belts $\mathbf{9}_1$ to $\mathbf{9}_5$ and $\mathbf{10}_1$ to $\mathbf{10}_4$ in the lower transport belt unit 2 and the transport belts $\mathbf{16}_1$ to $\mathbf{16}_5$ and $\mathbf{17}_1$ to $\mathbf{17}_4$ in the upper transport belt unit 3, ink droplets are ejected from the head unit 4 onto the printing medium 8 so as to print images according to the execution command. Finally, the printing medium 8 is stored in the sheet output unit 7.

In the above-described embodiment, the upstream lower transport unit 9 and the downstream lower transport unit 10 shown in FIG. 1 correspond to the first transport belt group in the claims. Similarly, the upstream upper transport unit 16 and the downstream upper transport unit 17 shown in FIG. 1 correspond to the second transport belt group, and the mist collecting section 31 shown in FIG. 6 corresponds to the collecting unit.

Operational Advantages (1) In the ink jet printer according to the above-described embodiment, the printing medium 8 is transported while being clamped between the upstream lower transport unit 9 and the upstream upper transport unit 16 and between the downstream lower transport unit 10 and the downstream upper transport unit 17. Therefore, the position of the printing medium 8 relative to the upstream lower transport unit 9 and the downstream lower transport unit 10 can be retained during transportation, without using static electricity. As a result, ink mist is prevented from being attracted and attached to the transport belts $\mathbf{9}_1$ to $\mathbf{9}_5$ and $\mathbf{10}_1$ to $\mathbf{10}_4$ by static electricity and from soiling the printing medium 8. This is different from, for example, the method in which the position of the printing medium 8 relative to the upstream lower transport unit 9 and the downstream lower transport unit 10 is retained by electrostatically attracting the printing medium 8 to the electrostatically charged transport belts $\mathbf{9}_1$ to $\mathbf{9}_5$ and $\mathbf{10}_1$ to $\mathbf{10}_4$ in the upstream lower transport unit 9 and the downstream lower transport unit 10.

Since the printing medium 8 is clamped between the upstream lower transport unit 9 and the upstream upper transport unit 16 and between the downstream lower transport unit 10 and the downstream upper transport unit 17, even if ink mist adheres to the transport belts $\mathbf{9}_1$ to $\mathbf{9}_5$ and $\mathbf{10}_1$ to $\mathbf{10}_4$ in the upstream lower transport unit 9 and the downstream lower transport unit 10, the force of retaining the printing medium 8 does not change. Consequently, the position of the printing medium 8 relative to the upstream lower transport unit 9 and the downstream lower transport unit 10 can be retained more properly.

Incidentally, in the method in which the printing medium 8 is electrostatically attracted to the electrostatically charged transport belts $\mathbf{9}_1$ to $\mathbf{9}_5$ and $\mathbf{10}_1$ to $\mathbf{10}_4$ in the upstream lower transport unit 9 and the downstream lower transport unit 10, even if ink mist adheres to the transport belts $\mathbf{9}_1$ to $\mathbf{9}_5$ and $\mathbf{10}_1$ to $\mathbf{10}_4$, the electrostatic attracting force decreases. As a result, it may be difficult to retain the position of the printing medium 8 relative to the upstream lower transport unit 9 and the downstream lower transport unit 10.

(2) The transport belts $\mathbf{16}_1$ to $\mathbf{16}_5$ of the upstream upper transport unit 16 and the transport belts $\mathbf{17}_1$ to $\mathbf{17}_4$ of the downstream upper transport unit 17 are arranged at predetermined intervals in the direction intersecting the transport direction of the printing medium 8. Further, the ink jet heads $\mathbf{23}_1$ to $\mathbf{23}_4$ of the upstream head unit 23 and the ink jet heads $\mathbf{24}_1$ to $\mathbf{24}_5$ of the downstream head unit 24 eject ink droplets onto regions of the printing medium 8 that are not in contact with the transport belts $\mathbf{16}_1$ to $\mathbf{16}_5$ and $\mathbf{17}_1$ to $\mathbf{17}_4$. Therefore, the printing medium 8 can be more properly clamped at more positions.

(3) The blower fans 29 send air into the space between the upstream head unit 23 and the upstream lower transport unit 9 and the space between the downstream head unit 24 and the downstream lower transport unit 10. The suction fans 30 draw in air flows produced by the air sent by the blower fans 29. The mist collecting sections 31 collect ink mist contained in the air flows drawn by the suction fans 30. With this structure, the amount of ink mist floating in the above-described spaces can be reduced and the printing medium 8 can be prevented from being soiled with ink mist.

(4) The mist guides 28 are provided on the inner peripheral sides of the transport belts $\mathbf{16}_1$ to $\mathbf{16}_4$ of the upstream upper transport unit 16 and the transport belts $\mathbf{17}_1$ to $\mathbf{17}_4$ of the downstream upper transport unit 17 so as to cover the upstream head unit 23 and the downstream head unit 24. For this reason, ink mist floating between the upstream head unit 23 and the printing medium 8 and between the downstream head unit 24 and the printing medium 8 can be prevented from flowing downstream in the transport direction because of air flows produced by transportation of the printing medium 8, and the printing medium 8 can be more properly prevented from being soiled with ink mist.

Incidentally, if the mist guides 28 are not provided, ink mist floats between the ink jet heads $\mathbf{23}_1$ to $\mathbf{23}_4$ of the upstream head unit 23 and the printing medium 8 and between the downstream head unit 24 and the printing medium 8, and flows downstream in the transport direction because of air flows produced by transportation of the printing medium 8. Then, the ink mist floats between the inner peripheral sides of the transport belts $\mathbf{16}_1$ to $\mathbf{16}_4$ of the upstream upper transport unit 16 and the inner peripheral sides of the transport belts $\mathbf{17}_1$ to $\mathbf{17}_4$ of the downstream upper transport unit 17.

(5) The ink absorber 34 for absorbing ink mist contained in air flows is disposed at the position in the duct 33 where the air flows collide. This can decrease the frequency of exchange of the filter 35, and can efficiently collect ink mist.

(6) Since the surface of each of the transport belts $\mathbf{17}_1$ to $\mathbf{17}_4$ in the downstream upper transport unit 17 is covered with a repellent coating, ink ejected on the printing medium 8 can be prevented from adhering to the transport belts $\mathbf{17}_1$ to $\mathbf{17}_4$, and the printing medium 8 can be prevented from being soiled with the ink adhering to the transport belts $\mathbf{17}_1$ to $\mathbf{17}_4$.

Figure 7:
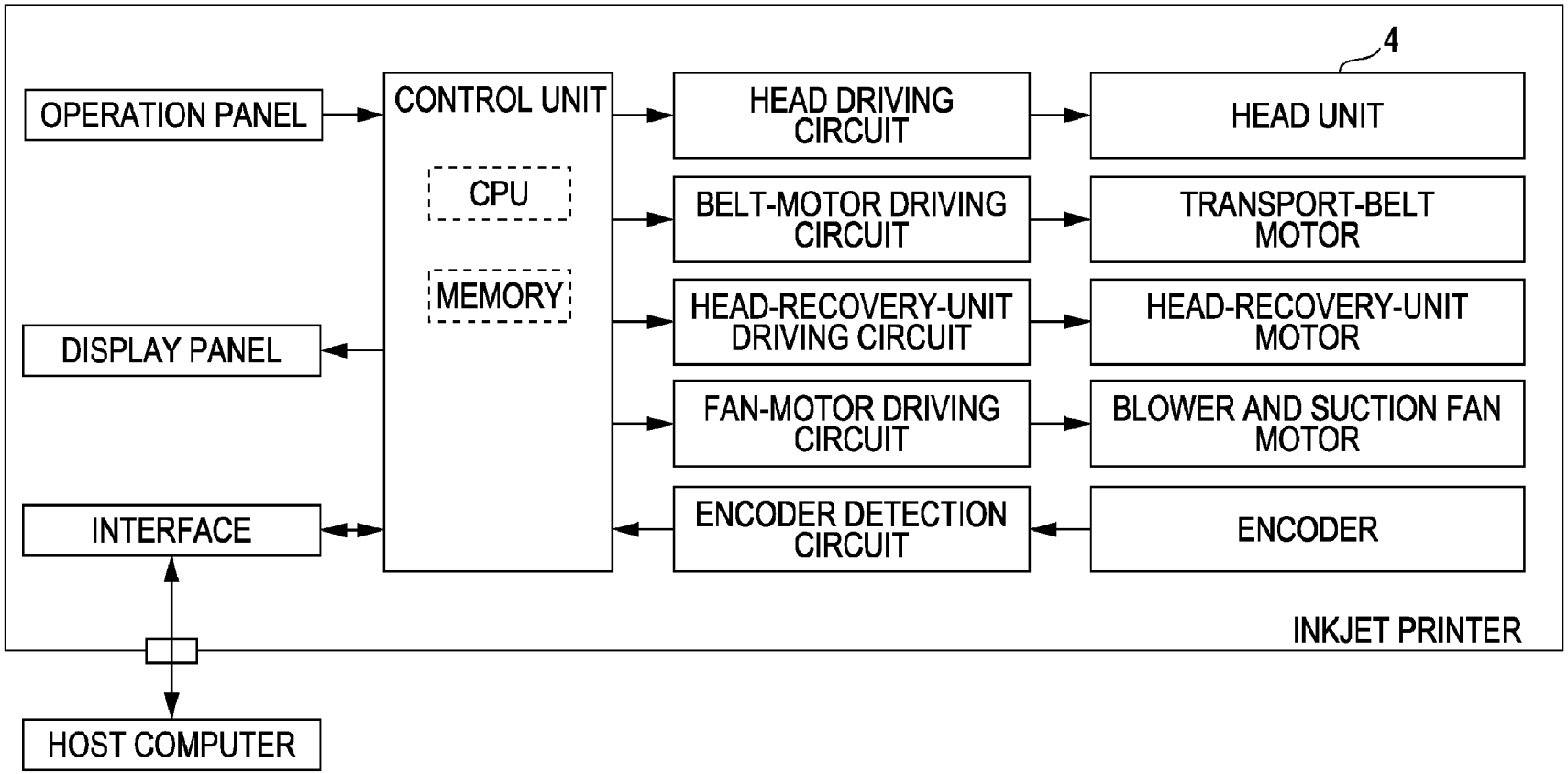
FIG. 7 is a block diagram showing the internal configuration of a modification of the ink jet printer.

(7) While the transport-belt motor is provided for each of the lower transport belt unit 2 and the upper transport belt unit 3 in this embodiment, the invention is not limited thereto. For example, only one transport-belt motor may be provided to drive both the lower transport belt unit 2 and the upper transport belt unit 3, as shown in FIG. 7.

What is claimed is:

1. A printing apparatus comprising:

a first transport belt group including endless belts arranged at predetermined intervals in a direction intersecting a transport direction of a printing medium;

a second transport belt group including endless belts arranged so as to oppose the first transport belt group, and configured to transport the printing medium while the printing medium is clamped between the first transport belt group and the second transport belt group; and a group of liquid ejecting heads provided between the endless belts of the first transport belt group or between the endless belts of the second transport belt group, and configured to eject liquid onto the printing medium being transported.

2. The printing apparatus according to claim 1, further comprising:

a collecting unit configured to form an air flow passing through a space surrounded by inner peripheral surfaces of the endless belts of the first transport belt group or the second transport belt group and to collect mist of the liquid contained in the air flow.

3. The printing apparatus according to claim 2, further comprising:

a mist guide provided along the inner peripheral surfaces of the endless belts of the first transport belt group or the second transport belt group.

4. The printing apparatus according to claim 2, wherein the collecting unit includes:

a duct configured to take in the air flow and to discharge the air flow from an air outlet;

a liquid absorber provided at a position in the duct with which the air flow collides, and configured to absorb the mist contained in the colliding air flow; and a filter provided at the air outlet and configured to absorb the mist contained in the air flow discharged from the air outlet.

5. The printing apparatus according to claim 1, wherein a surface of each of the endless belts of the first transport belt group or the second transport belt group is covered with a repellent coating.

* * * * *